US005816572A

United States Patent [19]

Chalfin

[11] Patent Number: 5,816,572

[45] Date of Patent: Oct. 6, 1998

[54] CHIP FOR BOARD GAME

[76] Inventor: William Chalfin, 1435 E. 101 St., Brooklyn, N.Y. 11236

[21] Appl. No.: 829,850

[22] Filed: Apr. 1, 1997

Related U.S. Application Data

[63] Continuation-in-part of Ser. No. 520,687, Aug. 29, 1995, Pat. No. 5,615,886, which is a continuation-in-part of Ser. No. 385,421, Feb. 9, 1995.

[51] Int. Cl.[6] ..... A63F 3/00

[52] U.S. Cl. ..... 273/272; 273/299

[58] Field of Search ..... 273/272, 299, 273/292, 293, 304, 306, DIG. 14; 446/901; 434/102, 170, 207, 177

[56] References Cited

U.S. PATENT DOCUMENTS 2,585,924 2/1952 Freedman et al. .

3,532,342 10/1970 Simpson et al. .

3,655,195 4/1972 Bean .

4,306,724 12/1981 Brzezinski et al. .

*Primary Examiner*—William M. Pierce

*Attorney, Agent, or Firm*—Robert W.J. Usher

[57] ABSTRACT

A chip for a crossword game having a transparent body and a letter and numerical value, marked on one face by hot stamping a foil having opposite faces of different colors so that players can readily perceive and identify whether they are looking at an outer face of the body on which the letter and numerical value are marked or at the underside of the letter and numerical value as viewed through the transparent body from the opposite face. This enables players to position chips on the racks correctly without need of further adjustment.

3 Claims, 1 Drawing Sheet

CHIP FOR BOARD GAME

This is a continuation-in-part application of Ser. No. 08/520,687, filed Aug. 29, 1995, to issue Apr. 1, 1997 as U.S. Pat. No. 5,615,886, which is a continuation-in-part application of Ser. No. 08/385,421, filed Feb. 9, 1995, pending, the disclosures of which are incorporated herein by reference.

FIELD OF THE INVENTION

The invention relates board games, particularly word games and to playing chips and game boards therefor

BACKGROUND OF THE INVENTION

In the above noted application, there is described a word game for two or more players wherein players alternately form words by placing transparent chips on a crossword grid on a gameboard to score points. The chip set includes a plurality of basic transparent playing chips each having a single letter indica and a single numerical value thereon and a plurality of enhanced transparent playing chips each having a first and a second region with a letter and numerical value in the first region and an alternative letter and numerical value in the second region, either of which can be used to form a word by selectively aligning the letter on the first or the second region with an adjacent chip on the crossword grid. The corresponding number value is then added to the player's score.

As the chip bodies are transparent, letters and values marked correctly on the upper faces of the chips can be seen by looking through the lower faces when the chips are upside down and, as a result, it can be difficult for many players, particularly children and the elderly with poorer eyesight, (for whom the game is otherwise well suited), to perceive immediately which face is the correct upper face, in spite of the fact that the letters and numbers will be laterally inverted, and will often position them incorrectly on the racks. Furthermore some letters and numbers such as K, O, 3 and 8 can have identical or similar appearances when laterally inverted, particularly when not upright and viewed from an angle. The problem is often exacerbated where a plurality of letters and values are marked on a single chip with some appearing the same even when laterally inverted with the increase in complexity can further confusing the player. As a result, initially, the players can often position chips incorrectly on the racks requiring subsequent fussy and time consuming rearrangement which irritates some players and slows the game.

SUMMARY OF THE INVENTION

An object of the invention is to avoid the above-mentioned disadvantage by providing a chip having a transparent body with opposite faces and an indicia, such as a letter or numerical value, marked on one face, which indicia has upper or outer side of a different color from a lower or underside so that players can readily perceive and identify whether they are looking at the face on which the indicia is marked or at the underside as viewed through the transparent body from the opposite face, enabling the players to place the chips on the racks correctly without need of further adjustment.

The different colors may be black and grey or any colors which may be readily distinguished from each other when glancing at the number directly on the correct face and or when viewing the inverted number through the transparent body from the opposite face.

According to one aspect of the invention, the indicia are marked on the faces of chips by a process known as "hot stamping" in which indicia forming portions of a foil having opposite outer and inner surfaces of different colors, respectively, (black and grey, respectively) are transferred from a "waxed" carrier sheet to a face of the chip body.

BRIEF DESCRIPTION OF THE DRAWINGS

In order that the invention may be readily understood a specific embodiment thereof will now be described by way of example only and with reference to the accompanying drawings in which.

Figure 1:
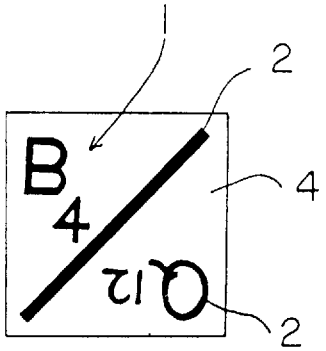
FIG. 1 is a diagrammatic plan view of an upper, indicia carrying face of enhanced chip according to the invention, and, FIG. 2 is a similar view showing the indicia viewed through the lower face and transparent body of the chip.
Figure 2:
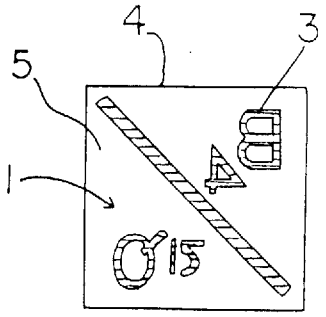

The indicia 1 have upper or outer surfaces 2 which are black and inner or lower surface 3 which are grey so that the indicia appear black when the upper face 4 of the chip carrying the indica is viewed directly. However, as shown in FIG. 2, when the chip is turned upside down so that the face 4 is lowermost and the indicia 1 are viewed through the opposite face 5 and the transparent chip body, the grey, inner or lower surface 3, of the indica are seen enabling the player to immediately identify the correct disposition of the chip prior to placement on a rack.

The indicia are marked on the faces of chips by a process known as "hot foil stamping" from a plastic carrier sheet having a release surface and a first, undercoat or layer of a first color and a second top coat or layer of a second color. Indicia comprising both coats or layers bonded together are released from the surface to adhere to a surface of the chip body by the selective application of heat and pressure forming the indicia with opposite surface of respective different colors with the second color underneath, against the body surface.

Other techniques such as silk screening or photo lithography for marking the two color indica on the chip body are possible.

I claim:

1. A chip for a crossword game having a transparent body with opposite faces and a letter and numerical value marked on one of the faces, in which said letter and numerical value have an outer surface which is of a different color from a lower surface which engage the chip body so that players can readily perceive and identify whether they are looking at an upper face of the body on which the letter and numerical value are marked or at an opposite face of the letter and numerical value as viewed through the transparent body, enabling the players to place the chips on a rack correctly without need of further adjustment.

2. A chip according to claim 1 wherein the outer surfaces of the letter and numerical value are black and the lower surfaces are light grey.

3. A chip according to claim 1 in which the letter and numerical value are marked on one face by hot stamping a foil having layers of different colors.

* * * * *